US010267588B2

(12) United States Patent
Evans et al.

(10) Patent No.: US 10,267,588 B2
(45) **Date of Patent: *Apr. 23, 2019**

(54) PAINTBALL SWAB

(71) Applicant: HTR Development, LLC, Gotha, FL (US)

(72) Inventors: Edward Evans, Whitby (CA); Benjamin Lynn Frederick, Gotha, FL (US)

(73) Assignee: HTR Development, LLC, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/584,353

(22) Filed: May 2, 2017

(65) Prior Publication Data

US 2017/0234640 A1 Aug. 17, 2017

Related U.S. Application Data

(63) Continuation of application No. 14/574,975, filed on Dec. 18, 2014, now Pat. No. 9,638,486.

(51) Int. Cl.

| | |
|---|---|
| ***F41A 29/02*** | (2006.01) |
| ***F41B 11/70*** | (2013.01) |
| ***B08B 9/04*** | (2006.01) |

(52) U.S. Cl.

CPC ..... *F41A 29/02* (2013.01); *B08B 9/04* (2013.01); *F41B 11/70* (2013.01)

(58) Field of Classification Search

CPC ..... F41A 29/00; F41A 29/02; F41B 11/70; B08B 9/02; B08B 9/027; B08B 9/04

USPC .... 15/104.05, 104.16, 104.17–104.19; 42/95

See application file for complete search history.

(56) References Cited

U.S. PATENT DOCUMENTS

| | | | |
|---|---|---|---|
| 1,516,438 | A | 11/1924 | Inskip |
| 1,599,307 | A | 9/1926 | Ward |
| 1,665,257 | A | 4/1928 | Dake |
| 1,875,413 | A | 9/1932 | Braly |
| 2,261,687 | A | 11/1941 | Lowry |
| 3,033,600 | A | 5/1952 | Drysdale |
| 3,064,294 | A | 11/1962 | Stocking |
| 4,698,932 | A | 10/1987 | Schneider |
| 4,866,871 | A | 9/1989 | Rivers |
| 4,930,240 | A | 6/1990 | Bice |
| 5,038,509 | A | 8/1991 | Stephan |
| 5,447,572 | A | 9/1995 | LaClair |
| 5,465,448 | A | 11/1995 | Tajima et al. |
| 5,588,242 | A | 12/1996 | Hughes |
| D393,115 | S | 3/1998 | Bell |

(Continued)

FOREIGN PATENT DOCUMENTS

| | | | |
|---|---|---|---|
| EP | 0427538 | A1 | 5/1991 |
| GB | 2141201 | A | 6/1983 |
| JP | 2000-312868 | | 11/2000 |

OTHER PUBLICATIONS

English Abstract for JP2000-312868.

*Primary Examiner* — Mark Spisich

(74) *Attorney, Agent, or Firm* — Woodard, Emhardt, Henry, Reeves & Wagner, LLP

(57) ABSTRACT

There are disclosed embodiments for a paintball swab. For example, a disk is pivotably and slidably attached to the distal end of a rod so there is a proximal and distal limit along the rod. When the disk is at the distal limit, it is perpendicular to the longitudinal axis of the rod. When the disk is at the proximal limit, it is angled with respect to the longitudinal axis of the rod.

12 Claims, 7 Drawing Sheets

(56) References Cited

U.S. PATENT DOCUMENTS

| | | | |
|---|---|---|---|
| 5,972,125 | A | 10/1999 | Hedge |
| 5,987,799 | A | 11/1999 | Dedeaux et al. |
| 6,088,866 | A | 7/2000 | Hedge |
| 6,701,658 | B1 | 3/2004 | Brownell |
| 7,055,279 | B2 | 6/2006 | Flores |
| D525,402 | S | 7/2006 | Dochterman |
| 7,367,151 | B1 | 5/2008 | Black et al. |
| 7,377,003 | B1 | 5/2008 | Dochterman et al. |
| 7,395,763 | B1 | 7/2008 | Vari |
| 7,836,624 | B1 | 11/2010 | Pennington |
| 8,176,592 | B1 | 5/2012 | Carpenter et al. |
| 8,661,724 | B2 | 3/2014 | Crawford |
| 2009/0283115 | A1 | 11/2009 | Dentico |
| 2011/0099880 | A1 | 5/2011 | Stephens et al. |

PAINTBALL SWAB

REFERENCE TO RELATED APPLICATIONS

This application is a continuation of U.S. application Ser. No. 14/574,975, filed Dec. 18, 2014, now U.S. Pat. No. 9,638,486, the entirety of which is incorporated herein by reference.

BACKGROUND

Paintball is a sport played by individuals or teams armed with pneumatic markers or guns that shoot pellets filled with paint or dye, known as paintballs. The location of games and the format played may vary, but the objective of most games is to shoot paintballs at other individuals, players on another team, or targets. Scoring is often determined by flag hangs, how long a base is held, or a variety of other completed objectives.

Paintballs are constructed to easily break on impact with a target; however, this means that paintballs often break within the paintball marker, paintball loader, or the barrel of the marker. Breakage within the marker can be the result of a number of causes including a paintball that is too small or too large, a paintball that is improperly loaded in the marker chamber, or manufacturing defects. When a paintball breaks within the paintball marker, the paint from the paintball coats the inner surfaces of the marker, usually including the barrel of the marker. The excess paint from the broken paintball can disrupt the ballistics of the marker and reduce accuracy or cause failure of the entire marker. This problem can be fixed by cleaning the equipment to rid the system of any excess paint.

A swab or a squeegee is a tool commonly used to clean the barrel of a paintball marker that contains paint from a broken paintball. One or both ends of the tool are typically covered with an absorbent material or flexible (e.g. rubber or rubber-like) material. When a paintball breaks in the barrel or a barrel otherwise needs cleaned or swept, the player sticks one end of the tool into the barrel. Twisting and/or removing the swab allows the absorbent or flexible end to soak up or move paint or other debris out of the barrel. Although structures and methods can be effective in removing much of the paint from the interior of the barrel, often some excess paint is still left behind, and the accuracy and firing issues due to the broken paintball remains.

There remains a need for a more effective cleaning apparatus for paintball equipment.

SUMMARY

Among other things, there are described cleaning elements for paintball equipment having cleaning disks that can move (e.g. pivot) with respect to a rod, to permit easy insertion into the equipment and pivoting to allow the cleaning disk to pull out paint or debris on withdrawal of the cleaning element from the equipment. For example, there is disclosed a cleaning element for paintball equipment that includes a rod having a longitudinal axis, a distal end portion, and a proximal end portion, and at least one disk coupled to the distal end portion of the rod so that the disk may pivot with respect to the rod. Embodiments include those in which the disk has a first position wherein it is positioned obliquely to the longitudinal axis of the rod and a second position wherein the disk is substantially perpendicular to the longitudinal axis of the rod. The disk has a proximal surface, a distal surface, and a lateral edge, and at least a portion of the lateral edge is raised and is formed from a wiping material (e.g. rubber or rubber-like material) that can be used to remove liquid from paintball equipment. In particular embodiments, friction between the disk and the equipment moves the disk between the first and second positions.

Particular embodiments can also include a holding piece movably mounted to the distal end portion of the rod, the holding piece being slidable along the longitudinal axis of the rod. The position of the holding piece on the rod can have a distal limit and a proximal limit, and when the holding piece is at the distal limit, it contacts the proximal surface of the disk and holds the disk in the second position (substantially perpendicular to the rod). One or more friction fins may be attached to the holding piece, e.g. with the friction fins (four, in one example) extending radially from the holding piece. In specific embodiments the material used for the friction fins has a higher coefficient of friction than the wiping material of the disk. The diameter of the rod between the distal limit of the holding piece and the proximal limit of the holding piece is smaller than the diameter of the rod near its proximal end portion.

In particular embodiments, the disk is slidable along the longitudinal axis of the rod. The position of the disk on the rod may have a proximal limit, and the disk is in the first (oblique) position when it is at that proximal limit. The rod at or adjacent the proximal limit includes a notch for accommodating the disk in specific examples. The cleaning element can include a distal end cap at the distal end of the rod opposite the proximal limit. In some embodiments, the distal end portion of the rod has a first diameter abutting the end cap that narrows toward the proximal limit, and the disk has a central opening having a diameter substantially the same size as the first diameter of the distal end portion of the rod, so that as the disk approaches the end cap, interaction between the distal end portion and said disk within the central opening tends to orient the disk toward the second (substantially perpendicular) position. Embodiments can include a rod with a surface oblique to the longitudinal axis, and the disk can pivot to engage that oblique surface. The rod may have a connection piece attached to its proximal end portion for connection to another rod or other instruments.

Also disclosed is a cleaning element for paintball equipment that includes a rod having a first portion, a second portion, a distal end and a longitudinal axis, with the diameter of the first portion and the diameter of the distal end being greater than the diameter of the second portion. At least one disk having a proximal surface, a distal surface, and a lateral edge is provided, with at least a portion of the lateral edge raised and formed from a wiping material that can be used to remove liquid from paintball equipment. The disk includes an opening that has a diameter larger than the second portion of the rod, but smaller than the diameter of the first portion and the diameter of the distal end of the rod. The disk is coupled to the rod at the second portion so that the disk is slidable along the longitudinal axis and so that the disk may pivot with respect to the axis. The position of the disk has a distal limit and a proximal limit along the longitudinal axis, with the proximal limit being the point where the second portion of the rod meets the first portion of the rod and wherein the surface of the first portion of the rod is at an angle to the longitudinal axis at the proximal limit. The distal limit is the point where the second portion of the rod meets the distal end of the rod, and the surface of the distal end is substantially perpendicular to the longitudinal axis at the distal limit. When the disk is at the proximal limit, it contacts the first portion and is positioned obliquely to the longitudinal axis of the rod, and when the disk is at the distal limit, it contacts the distal end and is substantially perpendicular to the longitudinal axis of the rod.

Embodiments are also disclosed of a cleaning device for paintball equipment having a rod with at least one tab extending radially from the rod and a hollow tube operationally connected to a cleaning element, the tube having an internal ring diameter smaller than an outer diameter of the at least one tab. The hollow tube may be adapted to fit on the rod so that the internal ring diameter is adjacent the at least one tab. In embodiments in which one end of the rod includes a proximal segment, the proximal segment can be adapted to fit within a connection sleeve. In other embodiments, there may be two or more tabs, or the at least one tab has a distal end with a distal surface and a proximal end with a proximal surface and wherein the distal surface is at an oblique angle with respect to the surface of the rod. The proximal surface of the at least one tab is perpendicular with respect to the surface of the rod in particular examples. The hollow tube may extend distally beyond the distal end of the rod, and the cleaning element can include a microfiber material.

Further, embodiments are disclosed of cleaning devices for paintball equipment that include a rod having a grip portion and a holder segment wherein the holder segment is adapted to hold a cleaning element. For example, a tab can extend radially from the holder segment wherein one end of the tab is at an oblique angle with respect to the surface of the holder segment. The diameter of the grip portion is greater than the diameter of the holder segment. Examples can include a cleaning element having a hollow tube with an internal ring diameter smaller than an outer diameter of the tab, and such cleaning element can include a microfiber material. In embodiments in which a hollow tube is fitted on the rod, e.g. so that the internal ring diameter is proximal and adjacent the tab, the holder segment may have a proximal end and a distal end, e.g. with the proximal end including at least one ridge extending radially from the holder segment and the ridge may contact the interior of the hollow tube when the hollow tube is fitted on the rod. The proximal end of the tab can be perpendicular with respect to the surface of the holder segment. In some embodiments, there are two or more of the tabs, and they may be diametrically opposed on the swab segment. A proximal segment is operationally connected to the grip portion in particular examples, and the proximal segment may be adapted to fit within a connection sleeve.

Particular examples, as above, include a rubber or rubber-like wiping material and/or a connection piece attached to the proximal end of the rod. In some embodiments, the first portion of the rod has a constant diameter, and/or the second portion of the rod does not have a constant diameter.

These and other embodiments and combinations will be evident from the drawings and further description below.

DETAILED DESCRIPTION OF THE ILLUSTRATED EMBODIMENTS

Figure 1:
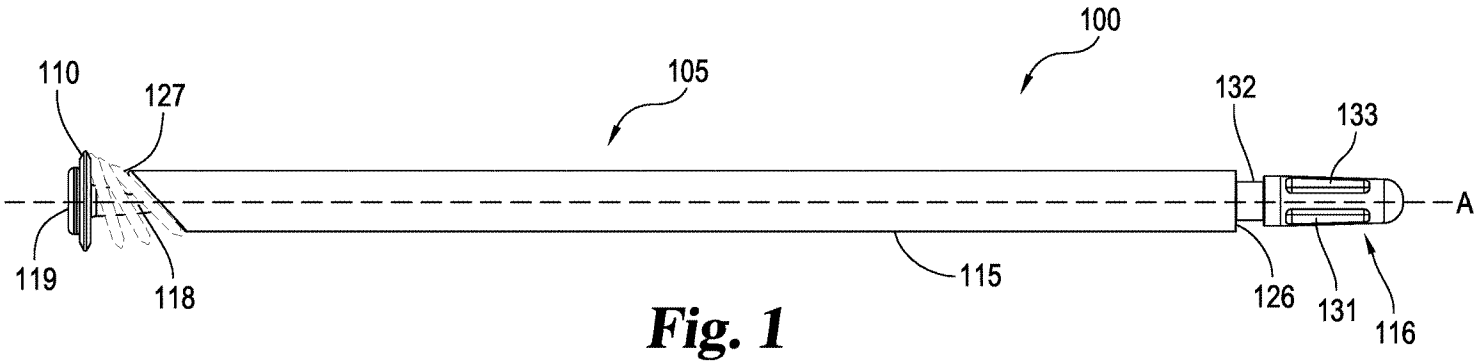
FIG. 1 is a side view of an embodiment of a portion of a paintball swab.

For the purposes of promoting an understanding of the principles of the disclosure, reference will now be made to the embodiments illustrated in the drawings and specific language will be used to describe the same. It will nevertheless be understood that no limitation of the scope of the claims is thereby intended, such alterations and further modifications in the illustrated embodiments, and such further applications of the principles of the disclosure as illustrated therein being contemplated as would normally occur to one skilled in the art to which the disclosure relates.

Referring now generally to the drawings, embodiments of a part of a paintball swab 100 are shown. Paintball swab 100 cleans and/or removes liquid and other debris from paintball equipment, for example a paintball marker. The discussion below centers around the use of paintball swab 100 to clean a paintball marker, but it will be understood that it can be used with other equipment. FIG. 1 shows a view of an embodiment of a part of paintball swab 100 that includes a rod 105 and a disk 110. Disk 110 is movable and pivotable with respect to rod 105 as further discussed below. It will be understood that rod 105 may be joined to a second rod or a collection of rods, whether similar to or different from rod 105, as is disclosed in application Ser. No. 13/281,746 (filed Oct. 26, 2011) or Ser. No. 13/832,274 (filed Mar. 15, 2013), each of which are incorporated herein by reference in their entirety.

Rod 105 includes a middle segment 115, a connection segment 116, a narrow segment 118, and a distal end cap 119. Rod 105 is preferably long enough so that cap 119 can reach the end of the barrel B of a paintball marker (e.g. to or near the breach of the marker) when the swab is used, so it is possible to clean the entire barrel.

Middle segment 115 has a proximal end surface 126 and a distal end surface 127. The proximal end of swab 100 is defined to be the end including the connection segment 116 because this is the end of swab 100 that is closer to the user's hand during use. The distal end of swab 100 is considered to be the end with disk 110. Middle segment 115 has a diameter that is smaller than the diameter of the bore of a paintball marker barrel and ends at distal end surface 127. Distal end surface 127 is oriented at an angle with respect to longitudinal axis A, and in the illustrated embodiment the angle is about 45 degrees (e.g. about 40-50 degrees).

In the illustrated embodiment, middle segment 115 is cylindrically shaped with a constant diameter. In other embodiments middle segment 115 may have a changing diameter along its length, as long as the diameter is not greater than the diameter of the paintball marker barrel. Also, in other embodiments, middle segment 115 may be another shape that fits inside a paintball marker barrel.

The connection segment 116 includes a connector piece 131, a narrowed portion 132, and grooves 133. Connection segment 116 is attached to the proximal end surface 126 of the middle segment 115 by its narrowed portion 132. Connector piece 131 extends distally from narrowed portion 132. In some embodiments, multiple grooves 133 are present on connector piece 131 around its circumference. In other embodiments, however, the connector piece does not have grooves 133 (as shown in FIG. 1).

Connection segment 116 can be inserted into a connector (e.g. one described in application Ser. No. 13/832,274, incorporated by reference herein) to connect swab 100 to a rod similar or identical to rod 105 or others disclosed herein, a rod having absorbent material, or other instruments. These instruments, for example, may be other cleaning instruments, like an absorbent element, or could be instruments that extend the length of swab 100.

Connection segment 116 may be made of the same material as middle segment 115, or in other embodiments it may be made from a different material, like a non-slip rubber, micro fiber or similar material. While segment 116 is shown as narrowed with respect to middle segment 115, with the advantages that provides, other embodiments may have a connection segment 116 of substantially the same diameter as middle segment 115.

Figure 2:
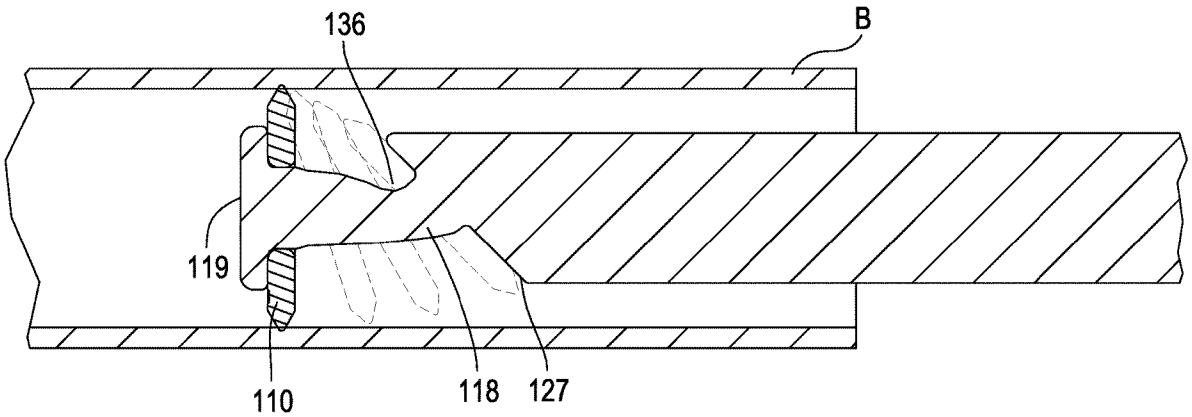
FIG. 2 is a cross-sectional view of the distal end of the embodiment shown in FIG. 1.
Figure 3:
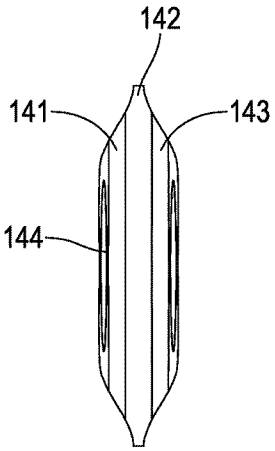
FIG. 3 is a side view of a disk of the embodiment of FIG. 1.

A narrow segment 118 of rod 105 is attached to distal end surface 127 of segment 115. The diameter of narrow segment 118 is smaller than the diameter of segment 115, and in the illustrated embodiment, varies along its length. At its proximal end (adjacent surface 127), segment 118 is angled upward (as seen in FIG. 2) as it attaches to distal end surface 127 so that the central axis of segment 118 is perpendicular or approximately so to surface 127. This angle and further narrowing of segment 118 on one side creates a notch 136 (shown in FIG. 2). From notch 136, segment 118 is generally conically shaped in the illustrated embodiment so the diameter increases distally until it reaches end cap 119.

Distal end cap 119 is fixed at the distal end of narrow segment 118. The end cap 119 is the distal-most portion of rod 105 and is substantially perpendicular to the longitudinal axis of rod 105 in this embodiment. It has a diameter that is larger than the diameter of narrow segment 118. In the embodiment shown in FIG. 2, the diameter of distal end cap 119 is approximately equal to the diameter of middle segment 115. In other embodiments, however, distal end cap 119 may have a diameter that differs from the diameter of the middle segment 115.

Disk 110 is placed movably and rotatably around segment 118 between cap 119 and surface 127 in the illustrated embodiment. Only one disk 110 is shown in four different positions and orientations, although multiple disks could be employed. FIGS. 1 and 2 demonstrate the potential movement and positioning during movement of disk 110 along segment 118. Disk 110 in the illustrated embodiment is a generally round or circular frame of sturdy material (e.g. hard plastic) with a distal disk surface 141, a proximal disk surface 143, and a disk opening 144. A wiping portion 142 fits tightly in an annular groove around the circumference of the frame. Distal disk surface 141 and proximal disk surface 143 are on either side of the wiping portion 142 of disk 110. Wiping portion 142 is made from a flexible fluid-proof or fluid-resistant material (e.g. rubber, micro fiber or similar materials). Preferably, the friction between disk 110 and segment 118 is less than the friction between wiping portion 142 and barrel B. In other embodiments, the entirety of disk 110 is made of the same material so that it is constructed as one piece.

Disk opening 144 extends through the center of disk 110. Opening 144 has a diameter that is about the size of or slightly larger than the largest portion of segment 118 (i.e. the portion abutting cap 119 in the illustrated embodiment) but that is smaller than the diameter of middle segment 115 and distal end cap 119. Opening 144 has a beveled or slanted edge on at least the distal side of disk 110 for ease of movement toward cap 119. Opening 144 fits around narrow segment 118 so disk 110 is able to easily slide on segment 118 substantially along the longitudinal axis A of swab 100. Because segment 118 narrows from cap 119 toward surface 127 in this embodiment, opening 144 will be significantly larger than the diameter of segment 118 near surface 127 (due to the narrowing (e.g. conical narrowing) of segment 118) and than notch 136.

The outer diameter of disk 110 is determined by the outer dimension of wiping portion 142, which extends from distal surface 141 and proximal surface 143. In some embodiments, the diameter of disk 110 is equal to or slightly larger than the diameter of the barrel of a paintball marker that is to be cleaned. The ends of wiping portion 142 are flexible so it may bend so that swab 100 may be slid into and out of the barrel. Because the diameter of disk 110 is larger than that of the barrel, wiping portion 142 contacts all sides of the barrel upon removal so that any excess liquid, paint, or other debris is removed from the inside surface of the barrel, as discussed further below.

Disk 110 pivots on and moves along narrow segment 118 so that it has multiple orientations (see FIGS. 1-2) with respect to the longitudinal axis A. In one orientation in this embodiment, disk 110 is perpendicular to axis A, e.g. with disk 110 abutting cap 119. In other orientations, disk 110 is angled with respect to longitudinal axis A, seen in the representations of disk 110 proximal of cap 119 in FIGS. 1 and 2. The proximal limit of the disk's position along the axis A is defined by the location of the distal end 127 of middle segment 115. The distal limit of disk 110 is the location of distal end cap 119.

Due to the angled distal end surface 127 of middle segment 115, when disk 110 is at its proximal limit, it is in an angled orientation that is close to or matches the angle of end surface 127. When disk 110 is at its distal limit, it is pushed against the surface of the distal end cap 119. Forcing disk 110 toward and/or against these surfaces pivots disk 110 into different orientations, i.e. from an angled orientation near or at surface 127 to a perpendicular orientation that matches the proximal surface of the end cap 119, and vice versa.

In use, a user inserts the distal end of swab 100 into the barrel B of a paintball marker. Disk 110 may be at any orientation with respect to axis A or location along segment 118 when insertion begins. The wiping portion 142 of disk 110, by virtue of its outer diameter being larger than the inner diameter of barrel B, makes contact with the barrel. Friction between wiping portion 142 and the inner surface of barrel B causes disk 110 to slide proximally along segment 118 as swab 100 is pushed into the barrel. As disk 110 slides, it follows the contour of segment 118 into notch 136. Disk 110 pivots with respect to axis A and segment 118 by virtue of the contour of segment 118 and/or contact between surface 143 of disk 110 and surface 127. After reaching notch 136, disk 110 can slide up the angled portion of segment 118 so it is held against distal end 127 and oriented at the same or approximately the same angle as the surface of distal end 127. Once disk 110 reaches distal end 127, friction from engagement of portion 142 and barrel B holds disk 110 against distal end 127 so it no longer slides as swab 100 is pushed farther into barrel B.

During insertion or after swab 100 has been inserted into the barrel to the desired depth, the user may turn swab 100 substantially around axis A if desired, for example to gather paint or debris or avoid pushing substantial amounts of paint or debris further into the barrel. If so, disk 110 may turn with surface 127. The user removes swab 100 from barrel B by pulling it back through the barrel opening from where it was inserted. When swab 100 is first pulled backward (e.g. when disk 110 is at its proximal limit against the surface of distal end 127), friction between barrel B and wiping portion 142 causes disk 110 to move distally along segment 118, remaining for a time essentially in its longitudinal place within barrel B as swab 100 begins to be removed from the barrel. Disk 110 slides along segment 118, i.e. through and from notch 136 and then onto the portion of segment 118 where the diameter increases after notch 136. Disk 110 pivots upright (i.e. toward perpendicular with respect to axis A), due to the angle of segment 118 and its increasing diameter toward cap 119 and/or engagement of surface 141 of disk 110 with cap 119. In the illustrated embodiment, disk 110 is perpendicular with respect to axis A when it most fully engages end cap 119. The friction between barrel B and wiping portion 142 keeps disk 110 against cap 119 and thus in that orientation as swab 100 is removed from barrel B. In its substantially perpendicular orientation, wiping portion 142 preferably contacts the entire circumference of the interior of barrel B as swab 100 is removed, so paint and any other debris is ejected from the barrel.

Figure 4:
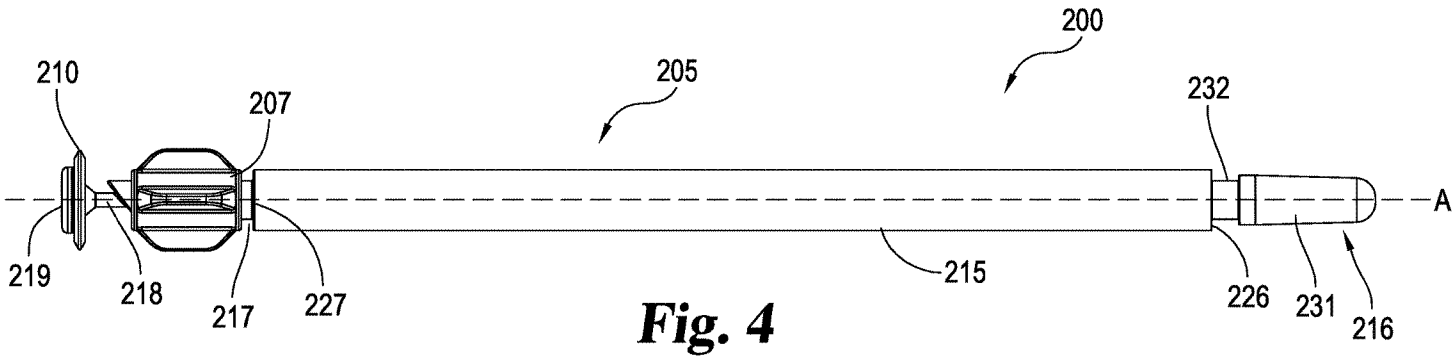
FIG. 4 is a side view of an embodiment of a portion of a paintball swab.

FIG. 4 shows a view of an embodiment of a portion of a paintball swab 200. In this embodiment, swab 200 includes a rod 205, a holding piece 207 and a disk 210. Disk 210 is movable and pivotable with respect to rod 205 as further discussed below.

Rod 205 includes a middle segment 215, a connection segment 216, a holding piece segment 217, a disk segment 218 and a distal end cap 219. Middle segment 215 and connection segment 216 are similar in most respects to middle segment 115 and connection segment 116 previously described in more detail. Middle segment 215 has a proximal end surface 226 and a distal end surface 227. Both end surfaces 226, 227 are substantially perpendicular to the longitudinal axis of rod 205. Connection segment 216 includes a connector piece 231 and a narrowed portion 232. Connector piece 231 attaches connection segment 216 to segment 215 at proximal end surface 226.

Figure 5:
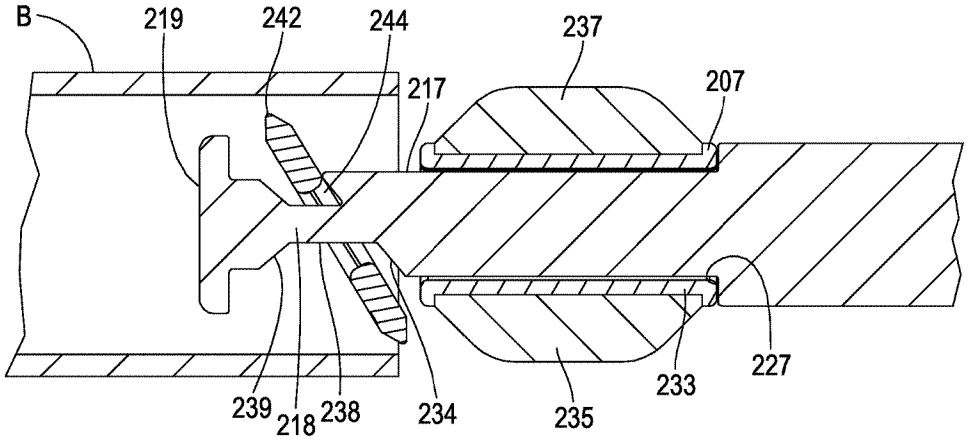
FIG. 5 is a cross-sectional view of the distal end of the embodiment shown in FIG. 4.

Holding piece segment 217 is attached to distal end surface 227 of middle segment 215 (see FIG. 4-5). The diameter of holding piece segment 217 is smaller than the diameter of middle segment 215. The distal end of holding piece segment 217 is angled with respect to the longitudinal axis A of swab 200. In the illustrated embodiment, the angle is similar to that of surface 127, e.g. about 45 degrees such as about 40-50 degrees.

Holding piece 207, in this embodiment, has an inner sleeve 233 and an outer gripping portion 235. It will be seen that in other embodiments piece 207 may be of a single piece. Sleeve 233 may be of a relatively low friction sturdy material (e.g. hard plastic), and has an opening 236 that fits around holding piece segment 217. The diameter of opening 236 is large enough that holding piece 207 is able to easily slide along the longitudinal axis of swab 200 on holding piece segment 217. However, the diameter of opening 236 is smaller than the diameter of middle segment 215 so holding piece 207 cannot slide onto segment 215. Distal end surface 227 of segment 215 acts as the proximal limit to which holding piece 207 may slide along axis A. Sleeve 233 in the illustrated embodiment has end bosses between which gripping portion 235 is fitted, to keep portion 235 from being pulled off of sleeve 233, and so that these pieces are at least substantially longitudinally fixed or have very limited longitudinal movability with respect to each other. In other embodiments, sleeve 233 and gripping portion 235 are made as one piece instead of being two separate pieces.

Figure 6:
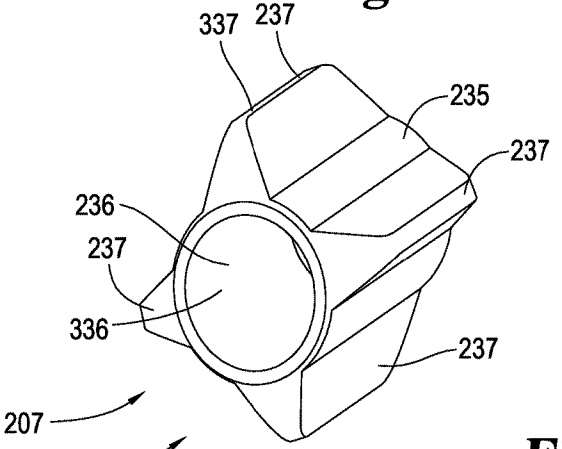
FIG. 6 is a perspective view of a holding piece of an embodiment of a paintball swab.

Gripping portion 235 includes one or more friction fins 237 (see FIG. 6), extending substantially radially from the center or longitudinal axis of piece 207. Friction fins 237 are sized so that they have an engaging fit with the inner surface of barrel B of a paintball marker (see FIG. 5). In the embodiment shown, there are four friction fins 237 each spaced about 90 degrees from adjacent fins, and opposing fins 237 together have an outer diameter that is the same or slightly larger than the inner diameter of barrel B. Fins 237 are flexible in this embodiment, to frictionally fit within and engage barrel B. In other embodiments a different number and/or orientation of fins may be used. For example, there may be only three friction fins, and/or non-uniform spacing between them. Friction fins 237 shown in FIG. 5 are shaped as trapezoids when seen in cross-section to provide a long side for engaging the barrel while giving a sloped end for support and to help with insertion, but other embodiments may have fins of different shapes, like cones or rectangular prisms. Similar to wiping portion 242 of disk 210, the friction between paintball marker barrel B and friction fins 237 is greater than the friction between friction fins 237 and segment 217.

Disk segment 218 is attached to the distal end of holding piece segment 217. Disk segment 218 is separated into two sections, a narrow portion 238 and an angled or expanded portion 239. Narrow portion 238 is the closest part to segment 217 and has a diameter smaller than the diameter of holding piece segment 217. The diameter of portion 239 increases uniformly (e.g. conically) in this embodiment, moving distally from narrow portion 238. The part of portion 239 abutting cap 219 is cylindrical in this embodiment.

Disk 210 is substantially similar to disk 110 described in detail above. Features of disk 210 are numbered with the same numbers used above, only using 2 instead of 1 as the first digit, as is the case with other features similar or identical between swab 200 and swab 100. Disk 210 includes an opening 244 that is about the same size or slightly larger than the outer diameter of the cylindrical part of portion 239 abutting cap 219, to assist in orienting disk 210.

Figure 7:
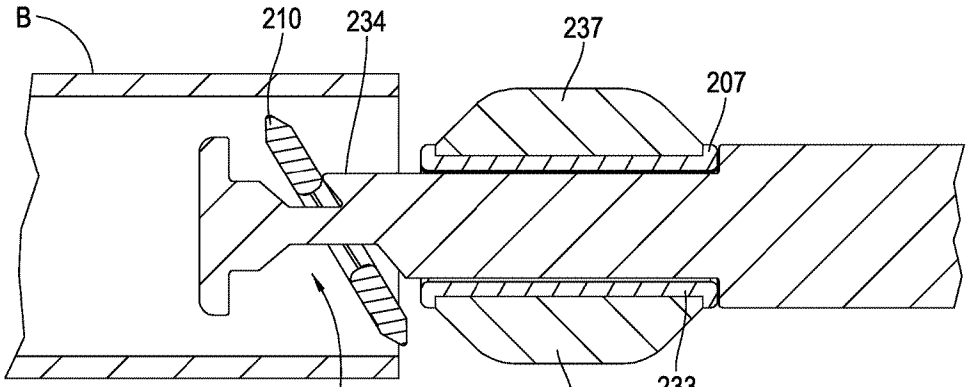
FIG. 7 is a cross-sectional view of the distal end of the embodiment shown in FIG. 4 where the holding piece is at its proximal limit.

To clean the barrel of a paintball marker, the distal end of swab 200 is inserted into barrel B. Similar to the operation of swab 100, friction between wiping portion 242 and barrel B of the paintball marker causes disk 210 to slide proximally along segment 218 as swab 200 is advanced into the barrel. Disk 210 may pivot as it moves and/or as it comes into contact with surface 234. Similarly, the friction between friction fins 237 and barrel B slides holding piece 207 proximally on segment 217 until it reaches distal end 227 (if piece 207 is not already adjacent surface 227). Disk 210 can slide far enough back on segment 218 and pivot so that angled distal end 234 contacts disk 210 and keeps disk 210 from sliding any farther along segment 218. Swab 200 may continue to be pushed into barrel B with holding piece 207 and disk 210 at their proximal limits adjacent or abutting segments 217 and 218, respectively (see FIG. 7).

Figure 8:
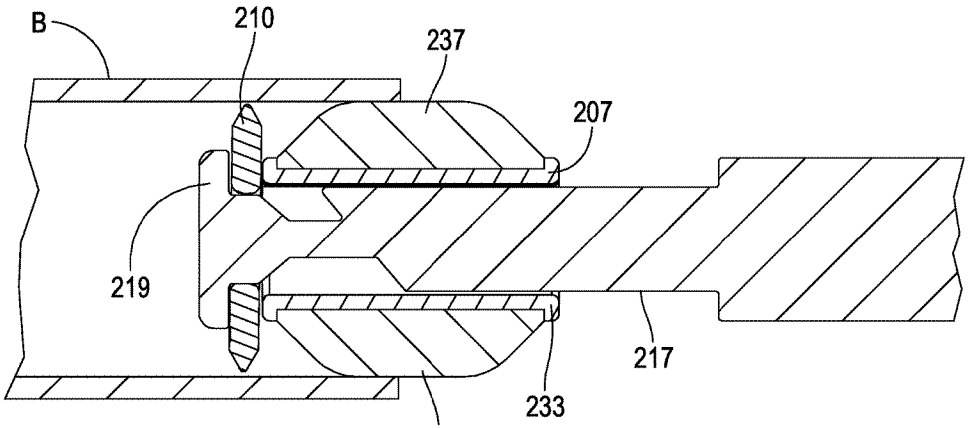
FIG. 8 is a cross-sectional view of the distal end of the embodiment shown in FIG. 4 where the holding piece is at its distal limit.

Once the user inserts swab 200 into barrel B into the desired depth, the user may turn swab 200 as indicated above with respect to swab 100. The user removes swab 200 by pulling swab 200 in the opposite direction of insertion, out of barrel of B. As swab 200 is pulled back, friction between wiping portion 242 and barrel B causes disk 210 to begin to slide distally along the contour of segment 218. At the same time as disk 210 is moving distally along segment 218, the friction between barrel B and friction fins 237 causes holding piece 207 to also move distally along segment 217. As disk 210 slides toward or onto expanded portion 239, it begins to pivot from an angled orientation to a more perpendicular orientation. Holding piece 207 slides distally along segment 217 so that it contacts the proximal surface of disk 210 and can assist in pushing disk 210 distally, toward end cap 219 (see FIG. 8). Disk 210 will eventually slide far enough to reach distal end cap 219 where it will be in a substantially perpendicular orientation when it is in contact with the end cap 219. Disk 210 and holding piece 207 stay in this position as swab 200 is removed from barrel B. Wiping portion 242 contacts substantially the entire circumference of barrel B and removes excess paint and debris from barrel B.

Figure 9:
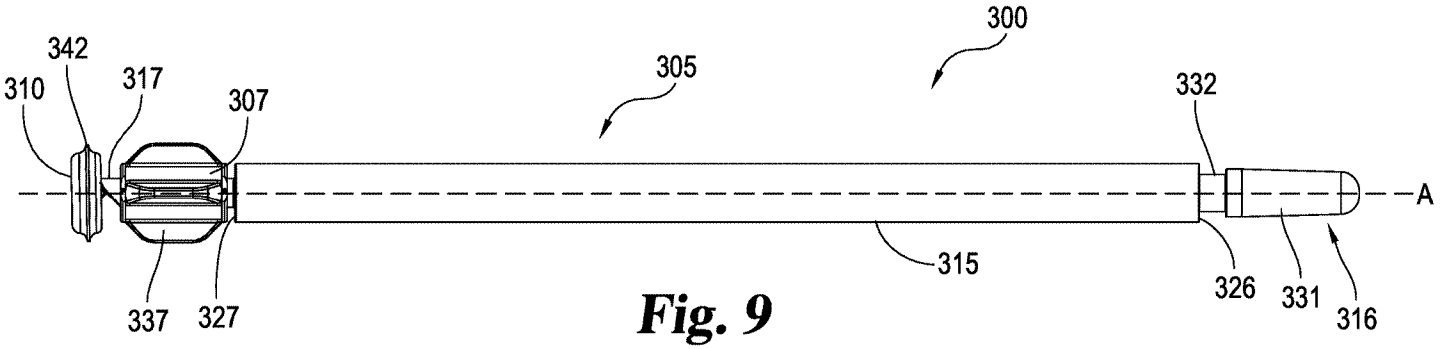
FIG. 9 is a side view of an embodiment of a portion of a paintball swab.

FIG. 9 shows a view of an embodiment of a portion of a paintball swab 300. In this embodiment, swab 300 includes a rod 305, a holding piece 307 and a disk 310. Disk 310 is pivotable with respect to rod 305 as further discussed below. Many aspects of swab 300 are similar to aspects described above, and are numbered similarly to above parts but beginning with the digit 3.

Rod 305 includes a middle segment 315, a connection segment 316, and a holding piece segment 317. The middle segment 315 and connection segment 316 in the embodiment shown in FIG. 9 are the same as or similar to middle segment 115 or 215 and connection segment 116 or 216 as shown and described in more detail above. Middle segment 315 includes a proximal end surface 326 and a distal end surface 327. Connection segment 316 includes a connector piece 331 and a narrowed portion 332. The connector piece attaches connection segment 316 to middle segment 315 at proximal end surface 326.

The holding piece segment 317 is attached to the distal end surface 327 of middle segment 315. The diameter of the holding piece segment 317 is smaller than the diameter of middle segment 315. The distal end of holding piece segment 317 is angled with respect to the longitudinal axis A of swab 300 in a fashion similar to that described with respect to segments 127, 227 above.

Holding piece 307 is substantially similar to holding piece 207. Piece 307 slides easily along segment 317.

Figure 10:
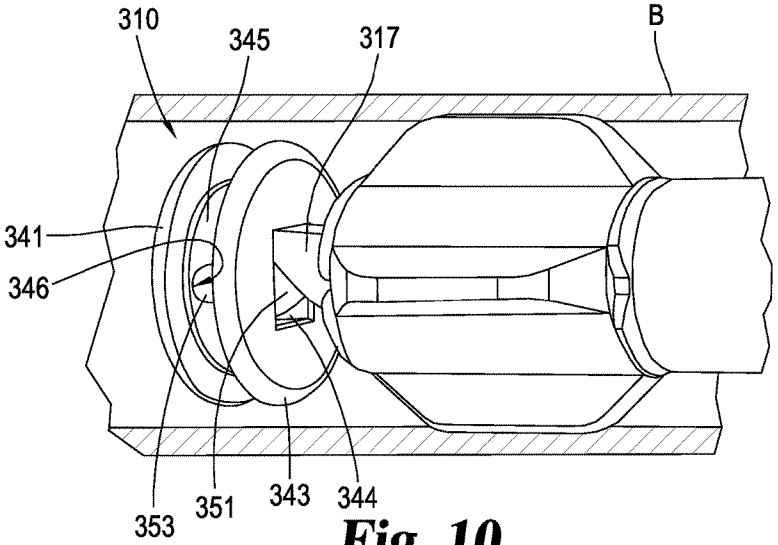
FIG. 10 is a perspective view of the distal end of the embodiment shown in FIG. 9.

An embodiment of disk 310 is shown in FIG. 10. It should be recognized that disk 310 in FIG. 10 is shown to be perpendicular only for the purpose of displaying the pivot attachment. In operation, if the holding piece were not contacting disk 310 as shown in FIG. 10, disk 310 would be in an angled orientation. Disk 310 is similar to disks 110, 210 described above, having a frame with a distal disk surface 341, a proximal disk surface 343, a pivot opening 344, a circumferential groove with a middle disk surface 345, and a pin opening 346. Wiping portion 342, similar or identical to wiping portions 142, 242, fits within the groove over surface 345. Distal disk surface 341 and proximal disk surface 343 are on respective sides of middle disk surface 345. Pin opening 346 runs laterally across the center of disk 310, forming holes on either side of the middle disk surface 345. As previously noted, wiping portion 342 sits around the middle disk surface 345, covering pin opening 346.

Pivot opening 344 extends through the center of proximal disk surface 343 and is large enough to fit around pivot 351. Pivot 351 is inserted into pivot opening 344 far enough so that a hole in pivot 351 lines up with pin opening 346. A pin 353 is inserted through pin opening 346 and the hole in pivot 351 to secure disk 310 to pivot 351. Wiping portion 342 covers pin opening 346 and keeps the pin from falling out.

As with the embodiments of disks 110, 210, the diameter of disk 310 is equal to or slightly larger than the diameter of the barrel of a paintball marker that is to be cleaned. The ends of wiping portion 342 are flexible so it may bend so that swab 300 may be slid into and out of the barrel. Because the diameter of disk 310 is larger than that of the barrel, wiping portion 342 contacts all sides of the barrel upon removal so that any excess liquid or paint is removed from the inside surface of the barrel.

Pivot 351 allows disk 310 to pivot so it has multiple orientations with respect to the longitudinal axis A. In one orientation, disk 310 is substantially perpendicular to axis A. In other orientations, disk 310 is angled with respect to longitudinal axis A.

When holding piece 307 is at its proximal limit (e.g. abutting surface 327), disk 310 is free to pivot from its perpendicular orientation to an angled orientation. However, when holding piece 307 is at its distal limit, the distal end of holding piece 307 contacts the proximal disk surface 343 and holds disk 310 in a substantially perpendicular orientation. The holding piece 307 does not allow disk 310 to rotate out of this orientation into an angled orientation when holding piece 307 is at its distal limit.

Swab 300 operates in a manner similar to swab 200; however, disk 310 cannot slide like disk 210. When swab 300 is inserted into barrel B, friction between wiping portion 342 and barrel B causes disk 310 to pivot so it is angled with respect to axis A. Disk 310 may pivot around pin 353 until it contacts the angled end of segment 317. As piece 307 enters barrel B, friction between friction fins 337 and barrel B causes holding piece 307 to slide proximally on segment 317 until it reaches distal end 327, if piece 307 is not already abutting end 327.

Once the user inserts swab 300 into barrel B into the desired depth, the user may turn swab 300 as noted above. The user removes swab 300 by pulling in the direction opposite to insertion, out of barrel of B. Friction between friction fins 337 and barrel B causes holding piece 307 to slide distally along segment 317. Holding piece 307 slides far enough to contact proximal disk surface 343 and push disk 310, rotating it around pin 353 toward and/or into a substantially perpendicular orientation with respect to axis A. As swab 300 is slid out of barrel B, holding piece 307 holds disk 310 in its substantially perpendicular orientation so that wiping portion 342 contacts substantially the entire circumference of barrel B and removes excess paint and debris from barrel B.

Figure 11:
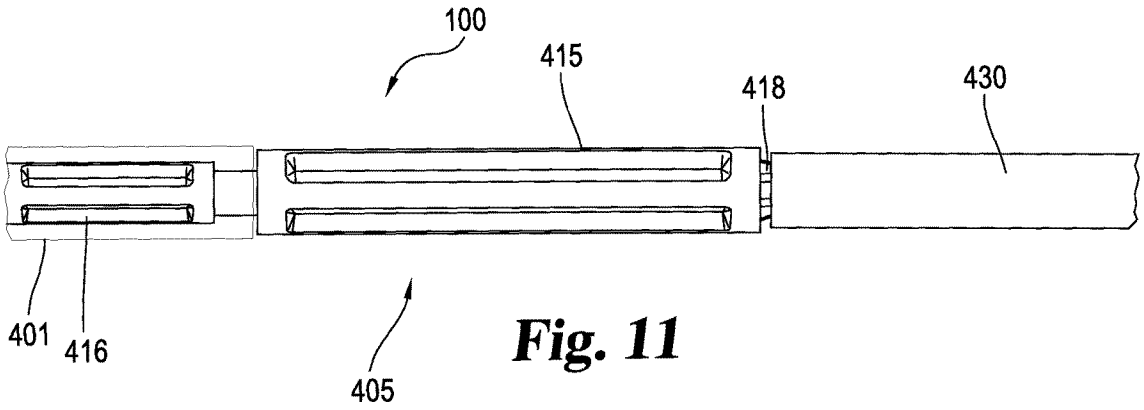
FIG. 11 is a side view of an embodiment of the extension rod portion of a paintball swab with an attached tube.
Figure 12:
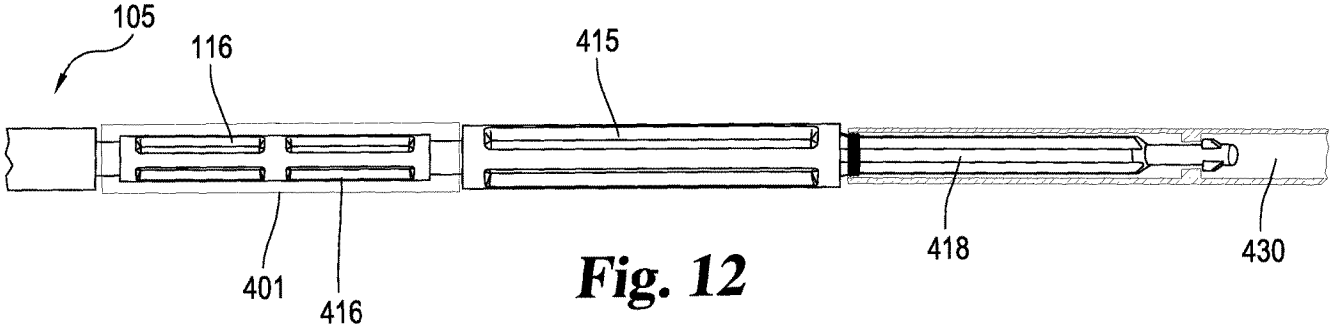
FIG. 12 is a perspective view of the embodiment of FIG. 11 with the tube made to be transparent.

As shown in FIGS. 11 and 12, in some embodiments of swab 100, sleeve 401 connects an extension rod 405 to rod 105. In the illustrated example, rod 405 comprises a grip portion 415, a proximal segment 416, and a holder segment 418. Proximal segment 416 is similar to connection segment 116 of rod 105 and is shaped to fit within sleeve 401. Proximal segment 416 is at the proximal end of second rod 405 and attached on one side to grip portion 415 which extends distally from proximal segment 416.

Figure 13:
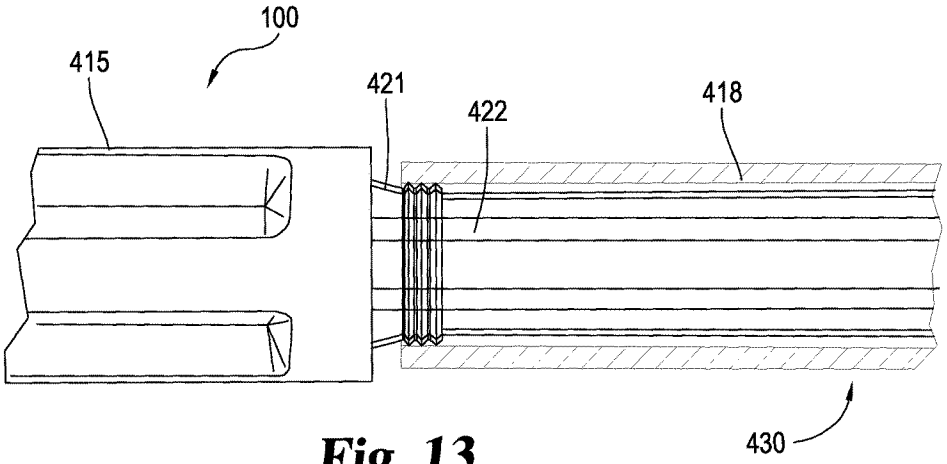
FIG. 13 is a side view of the embodiment of FIG. 12 showing the proximal end of the handle segment.
Figure 14:
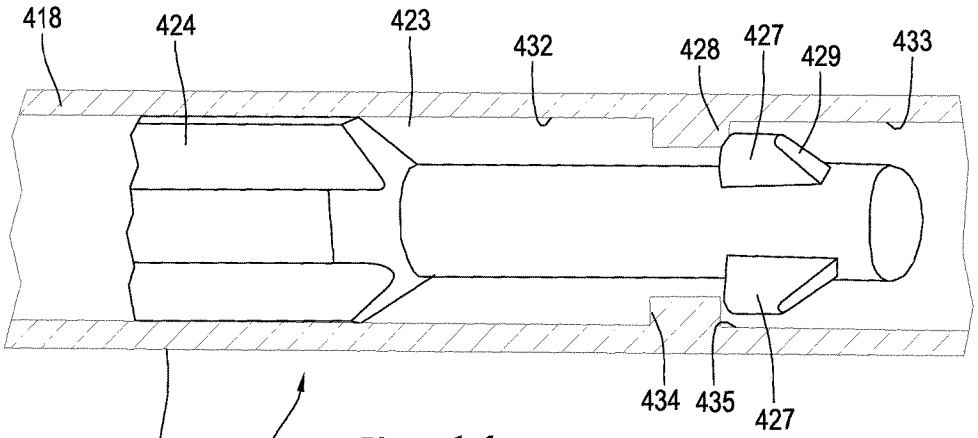
FIG. 14 is a side view of the embodiment of FIG. 12 showing the distal end of the handle segment.

A view of an embodiment of the proximal end of holder segment 418 is shown in FIG. 13 and a view of the distal end of holder segment 418 is shown in FIG. 14. Holder segment 418 extends from the distal end of grip portion 415. The diameter of holder segment 418 is smaller than the diameter of grip portion 415, and is greatest in this embodiment at the connection 421 of holder segment 418 and grip portion 415. Segment 418 is conically shaped in the illustrated example as it extends from medial segment 418, so its diameter decreases until reaching one or more notches or ridges 422 (three such ridges are shown in FIG. 13) near connection 421.

Grooves 424 on the outer surface of segment 418 run from connection 421 or ridges 422 to portion 423. These grooves 424 allow tubes or other objects to be more easily placed around holder segment 418 by reducing suction between the object and segment 418. The maximum diameter of segment 418, i.e. the diameter along portions adjacent grooves 424, is uniform in the illustrated embodiment. After ridges 422, the diameter of segment 418 is constant until portion 423 where it linearly decreases. After portion 423, the diameter remains constant to the distal end of segment 418.

Tabs 427 are positioned near the distal end of rod 405 and extend radially from the outer surface of segment 418. In the particular illustrated example, two tabs 427 are shown and are opposed to each other (e.g. approximately 180 degrees apart from each other) and identically configured. It will be understood that additional tabs (e.g. three or more) of the same or other configurations may be provided. The proximal end 428 of tab 427 is flat and extends substantially perpendicularly from the surface of segment 418. The distal end 429 of tab 427 is slanted so it is angled with respect to the surface of segment 418.

A cleaning element 430 that includes a hollow, circular tube 431, similar to a paint roller, may be fit around holder segment 418. Tube 431 is one piece in the illustrated embodiment, with the interior of tube 431 having three sections. Section 432 covers the portion of holder segment 418 that is closest to grip portion 415, while section 433 covers the end of holder segment 418 and extends distally, away from segment 418. Ring section 434 is positioned between section 432 and section 433 so it is just proximal of tabs 427 when tube 431 is fit onto holder segment 418. Tube 431 has a constant outer diameter in this embodiment. Ring section 434 has an internal diameter (a ring diameter) that is smaller than that of sections 432, 433, and is also smaller than the outer diameter of tabs 427, so that the inner surface 435 of section 433 contacts tabs 427 when tube 431 is forced over tabs 427.

Hollow tube 431 provides a paint-roller-like swab end, where a hollow shaft snaps into place over tabs 427. In use, tube 431 is slid onto rod 405 so that it covers holder segment 418. At the end closest to grip portion 415, tube 431 covers ridges or notches 422 so that material from tube 431 interengages with them, to assist in keeping tube 431 in place. Meanwhile, narrow segment 434 slides over tabs 427, with their respective slanted surfaces 424 forcing the diameter of segment 434 outward. When narrow segment 434 is proximal of tabs 427, segment 434 snaps over tabs 427, so that it abuts or is adjacent to a flat surface of tabs 427. Such contact or adjacent positioning of narrow segment 434 with flat parts of tabs 427 maintains tube 431 on holder segment 418. If the user wishes to remove tube 431 from segment 418, he or she may squeeze tube 431, in the illustrated embodiment substantially perpendicular to tabs 427, to give tube 431 an oval cross-section with a major diameter greater than the outer diameter of tabs 427, and allows narrow segment 434 to clear the flat portion of tabs 427. The user then pulls on tube 431 and it is removed from rod 405. A new tube 431 may then be attached to rod 405.

Cleaning element may have a swab material such as a microfiber material or a rubber material like a squeegee, attached to the outside of tube 431 as by gluing. Other embodiments may have any material attached to the outside of tube 431 that removes material or liquid from a surface. Alternatively, tube 431 itself may be made of a material that removes material or liquid from a surface. A microfiber paint roller-like swab end is provided, which can allow for easier and more cost-effective production and assembly. The easy removal and attachment of a new tube 431 permits replacement of old, ineffective, or overloaded swab ends. It is also contemplated that indicator marks (visual such as line(s), tactile such as ridge(s), or other indicators) may be incorporated in or applied to tube 431 and/or part of any material on the outside of tube 431 to show the user the position of tabs 427, so that the user knows where to squeeze tube 431 when removal or replacement is appropriate.

While the disclosure has been illustrated and described in detail in the drawings and foregoing description, the same is to be considered as illustrative and not restrictive in character, it being understood that only particular embodiments have been shown and described and that all changes, equivalents, and modifications that come within the spirit of the inventions defined by the following claims are desired to be protected. It will be understood that structures or other features described with respect to one particular embodiment or item may be used in connection or along with other features, items or embodiments included herein. All publications, patents, and patent applications cited in this specification are herein incorporated by reference as if each individual publication, patent, or patent application were specifically and individually indicated to be incorporated by reference and set forth in its entirety herein.

What is claimed is:

1. A cleaning element for paintball equipment, comprising:

a rod having a longitudinal axis, the rod having a proximal first segment with a distal end surface that is planar and obliquely angled with respect to the longitudinal axis, a narrow segment attached to the distal end surface of the first segment, and an end cap fixed to the narrow segment opposite to the distal end surface of the first segment;

at least one disk coupled around the narrow segment of the rod so that the disk may pivot with respect to the narrow segment, wherein the disk has a first position wherein the disk abuts the distal end surface of the first segment so that the disk is oriented obliquely to the longitudinal axis and a second position wherein the disk abuts the end cap so that the disk is substantially perpendicular to the longitudinal axis, the disk being movable along the narrow segment between the first and second positions;

wherein the disk has a proximal surface, a distal surface, and a lateral edge, and wherein at least a portion of the lateral edge is raised and is formed from a wiping material that can be used to remove liquid from paintball equipment; and, wherein friction between the disk and the equipment moves the disk between said first and second positions.

2. The cleaning element of claim 1, wherein the first position of the disk on the rod is a proximal limit.

3. The cleaning element of claim 2, wherein the narrow segment of the rod at or adjacent the proximal limit includes a notch for accommodating the disk.

4. The cleaning element of claim 2, wherein a portion of the narrow segment of the rod abutting the end cap is conical, and wherein said disk has a central opening having a diameter larger than a largest diameter of the narrow segment of the rod, so that as said disk approaches the end cap, interaction between the conical portion of the narrow segment and the disk within the central opening tends to orient the disk toward the second position.

5. The cleaning element of claim 1, wherein said wiping material is rubber.

6. The cleaning element of claim 1, further comprising a connection piece attached to the proximal first segment of said rod.

7. The cleaning element of claim 1, wherein the rod is monolithic.

8. A cleaning element for paintball equipment, comprising:

a rod having a first portion, a second narrowed portion, a distal end cap that abuts the second narrowed portion opposite the first portion, and a longitudinal axis, the first portion having a planar surface that is oblique to the axis abutting the second portion, wherein the diameter of the first portion and the diameter of the distal end cap is greater than the diameter of the second portion;

at least one disk, wherein the disk has a proximal surface, a distal surface, and a lateral edge, and wherein at least a portion of the lateral edge is raised and is formed from a wiping material that can be used to remove liquid from paintball equipment;

wherein the disk includes an opening that has a diameter larger than the second portion of the rod, but the disk opening diameter is smaller than the diameter of the first portion and the diameter of the distal end cap of the rod;

wherein said disk is coupled to the rod at said second portion so that the disk is slidable along the second portion and so that the disk may pivot with respect to the axis, and wherein the position of the disk has a distal limit and a proximal limit along said longitudinal axis of the rod;

wherein the proximal limit is the planar surface of the first portion of the rod;

wherein the distal limit is the point where the second portion of the rod meets the distal end cap of the rod and wherein the surface of the distal end cap is substantially perpendicular to the longitudinal axis at the distal limit;

wherein when the disk is at the proximal limit, the disk contacts the first portion and is positioned obliquely to the longitudinal axis of the rod; and, wherein when the disk is at the distal limit, said disk contacts the distal end cap and is substantially perpendicular to the longitudinal axis of the rod.

9. The cleaning element of claim 8, wherein said wiping material is rubber.

10. The cleaning element of claim 8, further comprising a connection piece attached to the first portion of said rod.

11. The cleaning element of claim 8, wherein said first portion of the rod has a constant diameter.

12. The cleaning element of claim 8, wherein said second portion of the rod does not have a constant diameter.

* * * * *